United States Patent [19]

Hosoi et al.

[11] Patent Number: 4,965,166

[45] Date of Patent: Oct. 23, 1990

[54] MULTICOLOR RECORDING MATERIAL

[75] Inventors: Noriyuki Hosoi; Toshimasa Usami, both of Shizuoka, Japan

[73] Assignee: Fuji Photo Film Co., Ltd., Kanagawa, Japan

[21] Appl. No.: 318,218

[22] Filed: Mar. 2, 1989

[30] Foreign Application Priority Data

| | | | |
|---|---|---|---|
| Mar. 2, 1988 | [JP] | Japan | 63-47517 |
| Apr. 25, 1988 | [JP] | Japan | 63-103630 |
| May 11, 1988 | [JP] | Japan | 63-115601 |
| May 23, 1988 | [JP] | Japan | 63-126590 |
| May 30, 1988 | [JP] | Japan | 63-132169 |

[51] Int. Cl.[5] ..... G03C 1/52; G03C 5/18

[52] U.S. Cl. ..... 430/156; 430/157; 430/162; 430/151; 430/138; 430/142; 503/204; 503/214; 503/216; 503/218

[58] Field of Search ..... 503/204; 430/138, 162, 430/151

[56] References Cited

U.S. PATENT DOCUMENTS

| | | | |
|---|---|---|---|
| 3,615,566 | 10/1971 | Robinson et al. | 430/138 |
| 3,843,384 | 10/1974 | Adachi et al. | 503/204 |
| 4,599,630 | 7/1986 | Ohtaki et al. | 503/204 |
| 4,613,878 | 9/1989 | Inaba et al. | 503/204 |
| 4,644,376 | 2/1987 | Usami et al. | 430/138 |
| 4,665,410 | 5/1987 | Iiyama et al. | 503/204 |
| 4,760,048 | 7/1988 | Kurihara et al. | 503/204 |

*Primary Examiner*—Paul R. Michl
*Assistant Examiner*—John S. Y. Chu
*Attorney, Agent, or Firm*—Sughrue, Mion, Zinn, Macpeak & Seas

[57] ABSTRACT

A multicolor recording material having on one side of a support at least two layers capable of producing colors different from each other in hue through respective color-producing reactions, which further has an interlayer constituted by a water-soluble polyanionic polymer having gelled through the interaction with a polycation between every adjacent two of said color-producing layers to prevent migration of ingredients from one color-producing layer to another.

13 Claims, No Drawings

MULTICOLOR RECORDING MATERIAL

FIELD OF THE INVENTION

This invention relates to a multicolor recording material and, more particularly, to a heat-sensitive recording material which has recording layers in such a multilayer form as to enable a multicolor recording.

BACKGROUND OF THE INVENTION

As the most general method for obtaining multicolor images, silver salt photography has been widely used up to now from the standpoints of high sensitivity, high image quality and abundance of gradation reproducibility. However, the silver salt photography has a defect that the image forming process is tedious since it comprises the steps of imagewise exposure, processing with a developer, and conversion of the remaining silver halide into a silver complex soluble in water or a silver salt stable to light.

For the purpose of obviating this defect, dry processable silver salt photographic materials are disclosed in Japanese Patent Publication (OPI) No. 48764/'84 (the term "OPI" as used herein means an "unexamined published Japanese patent application") and so on; dye diffusion transfer process photographic light-sensitive materials in British Patent No. 249530, U.S. Pat. Nos. 2,020,775, 2,004,625, 2,217,544, 2,255,463 and 2,699,394, and so on; silver dye bleach process photographic light-sensitive materials in U.S. Pat. No. 2,844,574, and so on.

On the other hand, recording methods using no silver salt in a recording material, but allotting the mechanism of multicolor recording to a recording apparatus, e.g., electrophotography, a thermal transfer method, an ink-jet method, etc., have been employed. However, these methods suffer from disadvantages that they require a large-sized apparatus and lack reliability of the obtained records, it takes much time to renew consumables, and so on.

Nonsilver salt recording materials into which multicolor recording mechanisms, which can work in combination with, e.g., a pressure-sensitive, heat-sensitive or light-sensitive color-producing method, are incorporated are disclosed, e.g., in Japanese Patent Publication (OPI) Nos. 134282/'88, 154386/'88, 172680/'88, 172681/'88, 189282/'88, 218392/'88 and 45084/'88 and so on.

As an example of conventional color-producing mechanisms incorporated in heat-sensitive recording materials, mention may be made of the mechanism in which plural color-producing units sequentially undergo color-producing reaction with an increase in thermal energy applied thereto, and the colors produced are simply mixed to cause changes in hue while accompanying turbidity, as disclosed in Japanese Patent Publication Nos. 19989/'76, 11231/'77, Japanese Patent Publication (OPI) Nos. 88135/'78, 133991/'79, 133992/'79, etc. As another example, mention may be made of the mechanism in which a decolorizing mechanism, such that color production in the color-producing unit having a higher thermal response temperature and the action of a decolorizer take place at the same time to decolorize the color produced in the color-producing unit having a lower thermal response temperature, is incorporated, as disclosed in Japanese Patent Publication Nos. 17868/'75, 5791/'76, 14318/'82, 14319/'82, and Japanese Patent Publication (OPI) No. 161688/'80.

In the recording materials having plural recording layers in a multilayer form to get a multicolor recording mechanisms, as described above, it is important to prevent the undersirable migration of ingredients of each layer to other layers.

More specifically, light-sensitive or/and heat-sensitive recording materials which utilize a combination of the first layer comprising a basic dye and a color developer with the second layer comprising a diazo compound and a coupler have problems that the color developer contained in the first layer acts on the second layer to accelerate the coupling reaction therein, and thereby fog generation goes on with the lapse of time in the second layer, and basic substances generally contained as a coupling accelerator in the diazo compound-coupler system hinder the color-producing reaction in the first layer to lower the density of the color to be produced in the first layer.

SUMMARY OF THE INVENTION

Therefore, a first object of this invention is to provide a recording material capable of producing multicolor images having high color densities and a low fog density.

A second object of this invention is to provide an interlayer suitable for preventing the migration of ingredients from one color-producing layer to another in a multicolor recording material having on one side of a support at least two recording layers to produce colors differing from each other in hue by color-producing reactions, respectively.

The above-described objects are attained with a multicolor recording material having on one side of a support at least two color-producing recording layers to produce colors differing from each other in hue by color-producing reactions, respectively, which further has an interlayer made up of a water-soluble polyanionic polymer having gelled through the interaction with a polycation between every adjacent two of said color-producing layers.

DETAILED DESCRIPTION OF THE INVENTION

Though this invention is not particularly restricted as to each color-producing layer to constitute the recording material, it prefers (1) a color-producing layer comprising a combination of a diazo compound with a coupler, (2) a color-producing layer comprising a combination of a electron donating dye precursor with a color developer, (3) a color-producing layer comprising a combination of an organic reducer, a chelating agent, a sulfur compound or the like with a metallic salt of organic acid, (4) a color-producing layer comprising a combination of an organic base with a material capable of producing a color by the reaction therewith, and so on.

Diazo compounds to be used in this invention are mainly intended to include organic ones, such as aromatic diazonium salts, aromatic diazosulfonate compounds, aromatic diazoamino compounds, and the like. As the representative of diazo compounds, diazonium salts are instanced, and described in detail below.

The diazonium salts are compounds represented by the general formula of $ArN_2^+ X^-$ (wherein Ar represents a substituted or unsubstituted aromatic moiety, $N_2^+$ represents a diazonium group, and $X^-$ represents an acid anion).

Examples of diazonium compounds which can be preferably used in this invention include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4 diazo-1-anilinobenzene, 4-diazo-1-toluylmercapto-2,5-diethoxybenzene, 4-diazo- 1,4-methoxybenzoylamino-2,5-diethoxybenzene, 1-diazo-4(N,N-dioctylcarbamoyl)benzene, 1-diazo-2-octadecyloxybenzene, 1-diazo-4-(4-tert-octylphenoxy)benzene, 1-diazo-4-(2,4-di-tertamylphenoxy)benzene,1-diazo-2-(4-tertoctylphenoxy)benzene, 1-diazo-5-chloro-2-(4-tertoctylphenoxy)benzene,1-diazo-2,5-bis-octadecyloxybenzene, 1-diazo-2,4-bis-octadecyloxybenzene, 1-diazo-4-(N-octylteuroylamino)benzene, and so on. Wavelengths at which aromatic diazonium compounds represented by the above-cited ones undergo photolysis can be widely changed by replacing their substituent groups with various ones.

Specific examples of acid anions include $C_nF_{2n+1}COO^-$(n=an integer of 3 to 9), $C_mF_{2m+1}SO_3^-$(m=an integer of 2 to 8), $(C_lF_{2l+1}SO_2)_2CH^-$(l=an integer of 1 to 18),

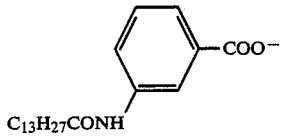

-continued

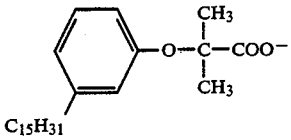

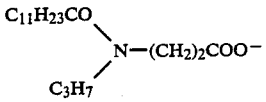

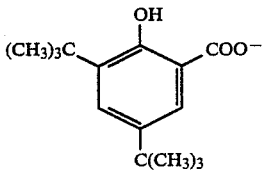

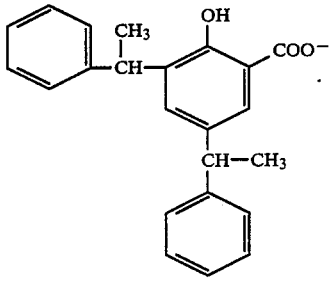

$PF_6^-$, and so on.

Of these acid anions, those conataining a perfluoroalkyl group or a perfluoroalkenyl group, and $PF_6^-$ are particularly preferred because they hardly cause an increase of fog upon storage before recording.

Specific examples of diazonium compounds (diazonium salts) are illustrated below.

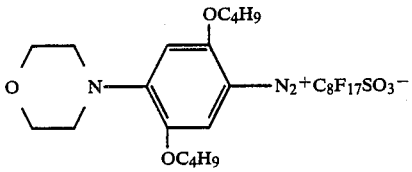

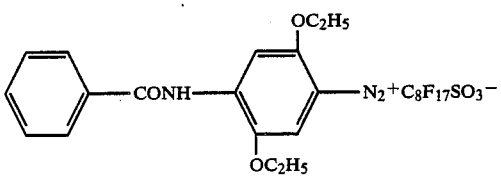

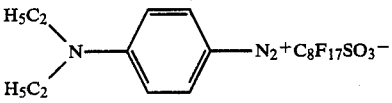

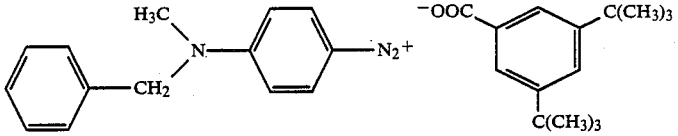

-continued

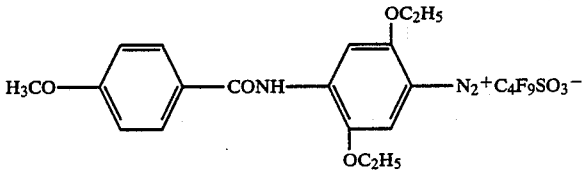

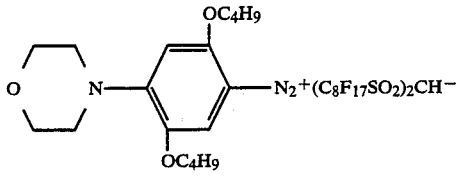

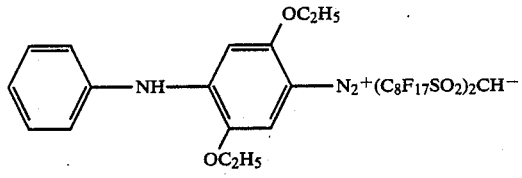

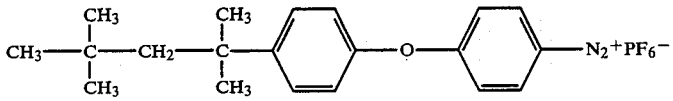

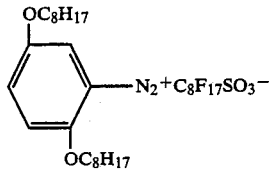

Diazosulfonate compounds which can be used in the present invention are those represented by the following general formula:

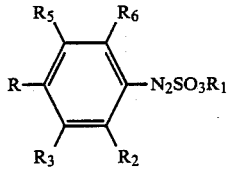

wherein $R_1$ represents an alkali metal, or an ammonium compound; $R_2$, $R_3$, $R_5$ and $R_6$ represent a hydrogen atom, a halogen atom, an alkyl group, or an alkoxyl group; and $R_4$ represents a hydrogen atom, a halogen atom, an alkyl group, an amino group, a benzoylamido group, a morpholino group, a trimercapto group, or a pyrrolidino group.

Many compounds are known as such diazosulfonates, and can be obtained by treating the corresponding diazonium salts with a sulfite.

Preferred examples of diazosulfonate compounds include benzenediazosulfonates having a substituent group such as 2-methoxy, 2-phenoxy, 2-methoxy-4-phenoxy, 2,4-dimethoxy, 2-methyl-4-methoxy, 2,4-dimethyl, 2,4,6-trimethyl, 4-phenyl, 4-phenoxy, 4-acetoamide, or so on; and benzenediazosulfonates having such a substituent group as 4-(N-ethyl-N-benzylamino), 4-(N,N-dimethylamino), 4-(N,N-diethylamino)-3-chloro, 4-pyrrolidino-3-chloro, 4-morpholino-2-methoxy, 4-(4'-methoxybenzylbenzoylamino)-2,5-butoxy, 4-(4'-trimercapto)-2,5-dimethoxy, or so on. When these diazosulfonate compounds are used, it is to be desired that irradiation with light should be carried out prior to recording for the purpose of activating them.

Other diazo compounds which can be used in the present invention include diazoamino compounds. The diazoamino compounds can be prepared by coupling diazonium salts with dicyanodiamide, sarcosine, methyltaurin, N-ethylanthranicacid-5-sulfonic acid, monoethanolamine, diethanolamine, guanidine, or so on.

A developing agent to be combined with diazo compounds which can be used in the present invention is a coupling components capable of forming dyes through coupling with the diazo compounds (diazonium salts).

As examples of coupling components which can be used, mention may be made of 2-hydroxy-3-naphthoic acid anilide, resorcinol, and compounds disclosed in Japanese Patent Application (OPI) No. 287485/85.

Combined use of two or more of these coupling components enables the production of images with any tones. The coupling reaction of the foregoing diazo compounds with these coupling components takes place readily under a basic atmosphere, so a basic subsatnce may be incorporated into the color-producing layer.

Usable basic substances are those slightly soluble or insoluble in water, and compounds capable of generating alkali by heating, with examples including inorganic or organic ammonium salts, organic amines, amides, urea, thiourea and their derivative, thiazoles, pyrroles, pyrimidines, piperazines, guanidines, indoles, imidazoles, imidazolines, triazoles, morpholines, piperidines, amidines, formamidines, pyridines, and other nitrogen-containing compounds. Specific examples of these compounds are described, e.g., in Japanese Patent Publication (OPI) No. 291183/'86. Two or more of these basic substances may be used together.

A hue in this color-producing system depends mainly on that of the diazo dye produced by the reaction of a diazo compound with a coupling component. Accordingly, the hue of a color to be produced, as well known, can be changed with ease by modifying the chemical structure of a diazo compound to be used, or/and that of a coupling component to be used, and hence almost all hues can be obtained by employing proper combinations, respectively. More specifically, various diazo compounds, one kind of coupling component and other additives may be incorporated into the same layer. In this case, each color-producing unit is constituted by a diazo compound different from one which constitutes every other color-producing unit, and a coupling component and other additives which are common to every other color-producing unit. On the other hand, coupling components different from one another are incorporated into separate layers, and each of these layers may contain the same diazo compound and the same additives. Therein, each color-producing unit is constituted by a coupling component different from one which constitutes every other color-producing unit, and a diazo compound and additives which are common to every other one. In any cases, each color-producing unit is constituted by a combination of one or more of a diazo compound and one or more of a coupling component, which are selected so as to provide an individual hue, and other additives.

It is desirable that a coupling component and a basic substance should be used in fractions of 0.1 to 10 parts by weight and 0.1 to 20 parts by weight, respectively, per 1 part by weight of a diazo compound.

The term "electron donating dye precursors" as used in this invention describes compounds of the kind which can form their colors through donation of an electron, or acceptance of a proton from an acid or the like, and does not have any other particular restrictions. Specifically, compounds which are, in general, almost colorless have a partial skeleton such as lactone, lactam, sulfone, spiropyran, ester, amide, etc., and cause a ring-opening or bond-cleavage reaction in such a partical skeleton upon the contact with a color developer can be employed in this invention. Suitable examples of such compounds include Crystal Violet lactone, benzoyl leuco Methylene Blue, Malachite Green lactone, Rhodamine B lactam, 1,2,3-trimethyl-6'-ethyl-8'-butoxyindolinobenzospiropyran, and so on.

Color developers to be used in combination with the above-described color formers include phenol compounds, organic acids or metallic salts thereof, hydroxybenzoates, and acidic substances such as activated clay and the like.

Specific examples of these color developers are described, e.g., in Japanese Patent Publication (OPI) No. 291183/'86.

It is desirable that a color developer as described above should be used in an amount of 0.3 to 80 parts by weight per 1 part by weight of a electron donating dye precursor.

Organic reducers, cheletaing agents and sulfur compounds to be employed in this invention as those which can develop colors by reacting with metallic salts of organic acids include tannic acid, gallic acid, sulfides of alkaline earth metals, sodium thiosulfate, thiourea, hexamethylene-tetramine, pyrogallol, hydroquinone, spiroindane, protocatechuic acid, thiosemicarbazides, thiourea derivatives, dithioxamides, thioacetamide, metal salts, N,N,-disubstituted rubeanic acids, tin compounds, zinc salt of dithiocarbamic acid, organic polyhydroxy compounds, thiosulfates, phenetidine hydrochloride, complex hydrazine derivatives, carbaminic acid esters, aromatic polyhydroxy compounds, spirobenzopyran, and so on. Specific examples of metallic salts of organic acids include iron (III) stearate, nickel stearate, cobalt stearate, copper stearate, lead stearate, heavy metal (Ag, Pb, Hg) salts of oxalic acid, tin stearate, silver behenate, silver stearate, iron (III) pelargonate, lead caproate, nickel acetate, ammonium molybdate, nickel behenate, cobalt behenate, bismuth compounds, iron salts of organic acids, water soluble lead or columbium salts, molybdic acid salts of organic amines, and the like.

Materials capable of producing colors through interaction with organic bases, which can be employed in this invention, include pH indicators to undergo change in color under an alkaline condition, fluorescein derivatives, phenolphthalein derivatives, materials capable of causing a color-changing phenomenon through oxidation or reduction in a wide sense due to a pH shift towards the alkali side, ninhydrin derivatives, and so on. Specific examples of these materials are illustrated below.

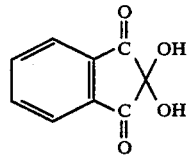

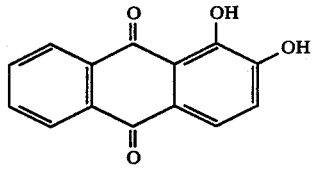

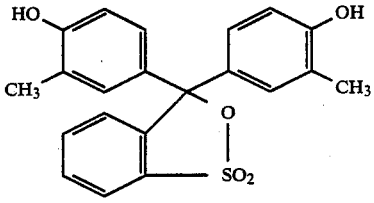

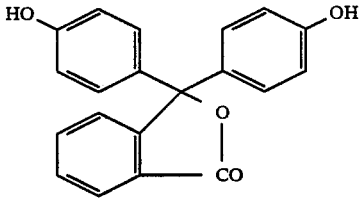

-continued

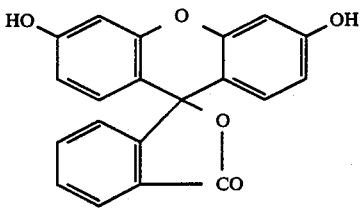

As suitable examples of organic bases which can produce colors by interacting with above mentioned materials, mention may be made of guanidine derivatives represented by the following general formulae:

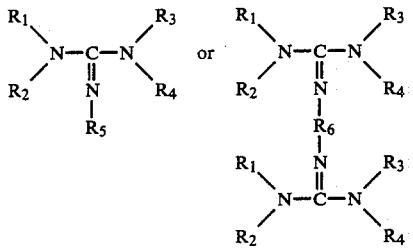

(wherein $R_1$, $R_2$, $R_3$, $R_4$ and $R_5$ each represents a hydrogen atom, an alkyl group containing not more than 18 carbon atoms, a cycloalkyl group, an aryl group, an aralkyl group, an amino group, an alkylamino group, an acylamino group, a carbamoyl group, an amidino group, cyano group, or a heterocyclyl group; and $R_6$ represents a lower alkylene, phenylene, naphthylene, or

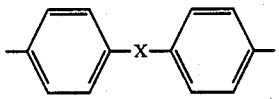

(wherein X represents a lower alkylene, $—SO_2—$, $—S_2—$, —S—, —O—, —NH—, or a single bond)). The aryl group present in the foregoing formulae may include those substituted by a group selected from among lower alkyl groups, alkoxy groups, nitro group, acylamino groups, alkylamino groups and halogen atoms.

In addition to the foregoing guanidine derivative, compounds represented by the following general formulae may be used:

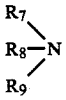

(wherein $R_7$, $R_8$ and $R_9$ each represents a hydrogen atom, an alkyl group containing up to 18 carbon atoms, an amino-substituted alkyl group, a cycloalkyl group, an aralkyl group or a hetercyclyl group, or at least two among $R_7$, $R_8$ and $R_9$ may combine with each other to form a ring together with N).

When at least one photo-oxidizing agent is employed as the color developer to be used in combination with a electron donating dye precursor as described before, a combination of this kind can be used as a color photodeveloping material, too. In this case, the photo-oxidizing agent is activated by irradiation with light, and reacts with a leuco dye to produce a colored image against the background made up of unexposed, hence the unchanged, substance.

Leuco dyes which can readily develop their colors with the aid of a photo-oxidizing agent include those described in U.S. Pat. No. 3,445,234. Specific examples thereof are cited below.

(a) Aminotriarylmethanes,
(b) Aminoxanthenes,
(c) Aminothioxanthenes,
(d) Amino-9,10-dihydroacridines,
(e) Aminophenoxazines,
(f) Aminophenothiazines,
(g) Aminodihydrophenazines,
(h) Aminodiphenylmethanes,
(i) Leuco indamines,
(j) Aminohydrocinnamic acid (cyanoethane, leuco methane,
(k) Hydrazines,
(l) Leuco indigoide dyes,
(m) Amino-2,3-dihydroanthraquinones,
(n) Tetrahalo-p,p'-biphenols,
(o) 2-(p-Hydroxyphenyl)-4,5-diphenylimidazoles,
(p) Phenetylanilines, Of these leuco dyes, the compounds from (a) to (i) develop their colors by losing one hydrogen atom to become dyes, and those from (j) to (p) produce parent dyes by losing two hydrogen atoms. In particular, aminotriarylmethanes (a) are preferred over others. In generally preferred aminotriarylmethanes, at least two of the aryl groups are phenyl groups which are substituted by (a)—$NR_1R_2$ (wherein $R_1$ and $R_2$ eachrepresents a hydrogen atom, an alkyl group containing 1 to 10 carbon atoms, 2-hydroxyethyl group, 2-cyanoethyl group or benzyl group) at the p-position to the methane carbon, and further substituted at the o-position to the methane carbon by (b) a group selected from among lower alkyl groups (containing 1 to 4 carbon atoms), lower alkoxy groups (containing 1 to 4 carbon atoms), fluorine, chlorine and bromine; and the third aryl group may be the same as the previous two, or not. When it differs from the previous two aryl groups, the third aryl group is selected from among (a) a phenyl group which may be substituted by a lower alkyl group, a lower alkoxy group, a chlorine atom, a diphenylamino group, a cyano group, a nitro group, a hydroxy group, a fluorine atom, a bromine atom, an alkylthio group, an arylthio group, a thioester, an alkysulfone group, a sulfonic acid group, a sulfamide group, an alkylamide group, an arylamide group or so on; (b) a naphthyl group which may be substituted by an amino group, a di-lower-alkylamino group, or an alkylamino group; (c) a pyridyl group which may be substituted by an alkyl group;(d) an quinolyl group; and (e) an indolinydene group which may be substituted by an alkyl group. These aminotriarylmethanes may assume the form of an acidic salt. As for $R_1$ and $R_2$, it is desirable that each substitutent should be a hydrogen atom or an alkyl group containing 1 to 4 carbon atoms. Particularly desirable ones among the above-described aminotriarylmethanes are characterized by the same three aryl groups contained therein.

Preferred photo-oxidizing agents which can make leuco dyes, which can undergo oxidative color-development, develop their colors are innactive before exposure to active radiation, such as visible rays, ultraviolet rays, infrared rays, X-rays, or so on. Each photo-oxidizing agent has spectral sensitivities different from every other photo-oxidizing agent depending on its chemical structure over the whole wavelength region. Accordingly, a specific photo-oxidizing agent is selected depending on the kind of active rays to be used. Only when exposed to the corresponding radiation, the photo-oxidizing agent produces the oxidizing agent capable of oxidizing a color former to convert to its colored form.

The representatives of photo-oxidizing agents include halogenated hydrocarbons disclosed in U.S. Pat. Nos. 3,042,515 and 3,502,476, including carbon tetrabromide, N-bromosuccinimide, tribromomethylphenylsulfone, etc., azide polymers described on page 55 of the gist collection of research works published in 1968 spring meeting of the photographic society of Japan; azide compounds disclosed in U.S. Pat. No. 3,282,693, including 2-azidobenzoxazole, benzoylazide, 2-azidobenzimidazole, etc.,; compounds disclosed in U.S. Pat. No. 3,615,568, including 3-ethyl-1-methoxy-2-pyridothiacyanine perchlorate, 1-methoxy-2-methylpyridinium-p-toluenesulfonate and so on; lophine dimer compounds disclosed in Japanese Patent Publication No. 39728/87, including 2,4,5-triarylimidazole dimer; compounds such as benzophenones, p-aminophenyl ketones, polynuclear quinones, thioxanthenes, etc.; and mixtures of two or more thereof. However, the invention should not be construed as being limited to the above-cited compounds.

Among the above-described color-producing reactions, color-producing reactions differing in kind, or those similar in kind but differing in hue of developed color may be combined, and employed for the first and the second color-producing layers.

Energy for causing the first and the second color-producing layers to undergo their respective color-producing reactions may be thermal energy, pressure, optical energy, electric energy, or a combination of two or more thereof.

Some component among those to take part in such a color-producing reaction as described above can be microcapsulated for the purposes of enhancing transparency, acquiring excellent freshness-keeping property (the prevention of fog) through prevention of contact between a color former and a color developer at ordinary temperatures, controlling coloration sensitivity so as to produce a color by application of desired quantity of energy, and so on.

Especially, it is desirable to enmicrocapsule the color former such as diazo compound, electron donating dye precursor, organic reducer, a chelating agent and sulfur compound.

Suitable examples of wall materials for the above-described microcapsules include polyurethane, polyurea, polyester, polycarbonate, urea-formaldehyde resin, melamine resin, polystyrene, styrene-methacrylate copolymers, styrene-acrylate copolymers, gelatin, polyvinylpyrrolidone, polyvinyl alcohol, and so on. Two or more of these high molecular compounds can be used together in this invention.

Among the foregoing high molecular compounds, polyurethane, polyurea, polyamide, polyester and polycarbonate, especially polyurethane and polyurea, are preferred over others in this invention.

Microcapsules to be used in this invention are prepared preferably by emulsifying a core material containing a reactive substance such as a color former or so on, and then walling in individual oil droplets by a high molecular substance to effect enmicrocapsulation. Therein, reactants to form a high molecular substance are added to the inside and/or the outside of individual oil droplets. Desirable preparation methods of microcapsules, and microcapsules which can be preferably used in this invention are described in detail, e.g., in Japanese Patent Publication(OPI) No. 242094/85.

Organic solvents to be used for forming oil droplets can be generally chosen from high boiling oils. In particular, organic solvents suitable for dissolution of color developers are preferably used in respects that solubilities of color formers therein are high, and they can contribute to increases in developed color density and color-developing speed and a decrease in fog upon thermal printing.

Microcapsules can be formed from an emulsion containing an ingredient to be enmicrocapsulated in a concentration of 0.2 wt % or more.

In order to improve the transparency of the recording layer, it is desirable to use color developers for before mentioned color formers in a form of an emulsified dispersion. The dispersion can be prepared by dissolving each color developer in an organic solvent slightly soluble or insoluble in water, and mixing the resulting solution with an aqueous phase which contains a surface active agent, and a water-soluble high polymer as a protective colloid to emulsify and to disperse the solution in the aqueous phase. Preferred examples of the organic solvents are described, e.g., in Japanese Patent Publication (OPI) No. 45084/'88 and 92489/'88.

Also, color-production assistants can be used in this invention.

The color-producing assistants which can be used in this invention when thermal energy is employed as applied energy are materials capable of heightening the developed color density or lowering the lowest color-production temperature at the time of thermal printing. More specifically, they are compounds of the kind which can create such a condition as to facilitate the reaction of a diazo compound, a basic substance, a coupling component, a color former or a color developer through their effect of lowering a melting point of a coupling component, a basic substance, a color former, a color developer or a diazo compound, or a softening point of a capsule wall.

Suitable color-production assistants include phenol compounds, alcoholic compounds, amide compounds, sulfonamide compounds, and so on. As specific examples of these compounds, mention may be made of p-tert-octylphenol, p-benzyloxyphenol, phenyl p-hydroxybenzoate, benzyl carbanilate, phenetyl carbanilate, hydroquinone dihydroxyethyl ether, xylylene diol, N-hydroxyethylmethanesulfonic acid amide, N-phenylmethanesulfonic acid amide, and the like. These color-production assistants may be incorporated into a core material, or added to the outside of microcapsules in the form of an emulsified dispersion.

The color-producing materials which can be used in this invention can be coated with the aids of proper binders.

Suitable examples of binders include polyvinyl alcohol, methyl cellulose, carboxymethyl cellulose, hydroxypropyl cellulose, gum arabic, gelatin, polyvinyl pyrrolidone, casein, styrene-butadiene latex, acrylonitrile-butadiene latex, and various emulsion of polyvinyl acetate, polyacrylic acid esters, ethylene-vinyl acetate copolymer and so on. Such a binder as described above is used at a coverage of 0.5 to 5 $g/m^2$ on a solids basis.

It is essential to this invention that an interlayer is provided between the first color-producing layer and the second one, and this interlayer is constituted particularly by a water-soluble polyanionic polymer having undergone gelation through the interaction with polycations.

Suitable water-soluble polyanionic polymers are those containing carboxyl, sulfo, or phospho groups, especially those containing carboxyl groups. Specific examples of preferable water-soluble anionic polymers include natural or synthetic polysaccharide gums (such as alkali metal salts of alginic acid, guar gum, gum arabic, carrageenan, pectin, tragacanth gum, xanthene gum, etc.), homo- and co-polymers of acrylic or methacrylic acids, homo- and co-polymers of maleic or phthalic acids, cellulose derivatives such as carboxymethyl cellulose, gelatin, agar and the like. Of these polymers, alkali metal salts of aliginic acid are particularly preferred. A preferred molecular weight of a water-soluble polyanionic polymer ranges from 5,000 to 100,000, particularly from 10,000 to 40,000 from the standpoint of achieving the barrier effect aimed at by this invention and ensuring a preparation aptitude.

As for the polycations, salts of alkaline earth metals and other polyvalent metals(e.g., $CaCl_2$, $BaCl_2$, $Al_2(SO_4)_3$, $ZnSO_4$), polyamines (e.g., ethylenediamine, diethylenetriamine, hexamethylenediamine) and polyimines are used to advantage.

As another preferred example of the interlayer of this invention, mention may be made of ion complexes of water-soluble polyanionic polymers and water-soluble polycationic polymers. Water-soluble polyanionic polymers usable in this case include the above-cited, various kinds of water-soluble polyanionic polymers.

Water-soluble cationic polymers which can be preferably used include proteins having plural reactive nitrogen-containing cationic groups, polypeptides such as polylysine, polyvinylamines, polyethyleneamines and polyethyleneimines.

In forming the interlayer to be constituted by the above-described materials, it is to be desired for prevention of rapid gelation in the course of coating that either of the two constituents should be incorporated in the first or second color-producing layer, and the two should be coated separately. The prevention of rapid gelation can also be effected by the control of temperature and pH, or by incorporation of one constituent into the first color-producing layer and the other into the second color-producing layer.

A preferred coverage of the interlayer ranges from 0.05 to 5 g/m$^2$, particularly from 0.1 to 2 g/m$^2$.

For the purpose of preventing fog and enhancing whiteness, a white pigment may be incorporated in the color-producing layers or the interlayers, or a layer containing a white pigment may be additionally provided.

Suitable examples of white pigments which can be used include talc, calcium carbonate, calcium sulfonate, magnesium carbonate, magnesium hydroxide, alumina, synthetic silica, titanium oxide, barium sulfate, kaolin, calcium silicate, carbon resins, and so on.

Further, a protective layer can be provided as the topmost layer.

The protective layer can be formed using a water-soluble high molecular compound, such as polyvinyl alcohol, polyvinyl pyrrolidone, polyacrylamide, methyl cellulose, ethyl cellulose, carboxymethyl cellulose, hydroxyethyl cellulose or the like, to which a pigment, a metallic soap, wax, a cross-linking agent or/and so on are added.

Suitable examples of such a pigment include calcium carbonate, barium sulfate, titanium oxide, lithopone, talc, agalmatolite, kaolin, aluminium hydroxide, noncrystalline silica and so on, and a preferred addition amount thereof is from 0.05 to 2 times, particularly from 0.1 to 5 times, the total weight of the polymers used together.

Suitable examples of such a metallic soap include emulsions of metal salts of higher fatty acids, such as zinc stearate, calcium stearate, aluminium stearate and the like, and they are added in a proportion of 0.5 to 20 wt %, preferably 1 to 10 wt %, to the whole weight of the protective layer.

Suitable examples of such wax include emulsions of paraffin wax, microcrystalline wax, carnauba wax, methylolstearoamide wax, polyethylene wax, silicone and so on, and it is added in a proportion of 0.5 to 40 wt %, preferably 1 to 20 wt %, to the whole weight of the protective layer.

In addition, a surfactant, a polyelectrolyte or the like may be added to the protective layer in order to prevent electrification of the heat sensitive recording material. A preferred coverage of the protective layer generally ranges from 0.2 to 5 g/m$^2$, particularly from 1 to 3 g/m$^2$, on a solids basis.

Details of the protective layer are described in Kami Pulp Gijutsu Times (which means "Paper Pulp Technology Times"), No. 8(1985).

Further, a subbing layer can be provided for the purposes of heightening the adhesiveness between a support and a color-producing layer, improving upon the smoothness, and giving a heat insulation effect.

Materials for forming the subbing layer include water-soluble macromolecules such as gelatin, latexes of synthetic polymers, nitrocellulose, and the like. A preferred coverage of the subbing layer ranges from 0.1 to 2.0 g/m$^2$, particularly from 0.2 to 1.0 g/m$^2$.

As examples of a support which can be used in this invention, mention may be made of paper, synthetic paper, polymer films and the like.

In particular, neutralized paper sized by a neutral size, such as an alkylketene dimer, to have a thermal extract pH of 6 to 9 (as disclosed in Japanese Patent Publication (OPI) No. 14281/80) can be used to advantage in respect of keeping property.

Also, paper satisfying the following relation.

$$\frac{\text{Stokigt sizing degree}}{(\text{basis weight (g/m}^2))^2} \geqq 3 \times 10^{-3}$$

and having Bekk smoothness of 90 seconds or more, as described in Japanese Patent Publication (OPI) 116687/82, is advantageous in that permeation of a coating solution into paper can be avoided.

Further, paper having an optical surface roughness of 8 microns or less and a thickness of 40 to 75 microns, as disclosed in Japanese Patent Application No. 136492/83; paper having a density of 0.9 g/cm$^3$ or less and an optical contact rate of 15% or more, as disclosed in Japanese Patent Publication(OPI) No. 69097/83; paper which is made from pulp beaten so as to have a beating degree of 400 ml or above, expressed in Canadian standard freeness (JIS P8121), to acquire resistivity against permeation of a coating solution, as disclosed in Japanese Patent Publication (OPI) No. 69097/83; base paper made with a Yankee machine, on the lustrous side of which coating is carried out to make improvements in developed color density and resolution, as disclosed in Japanese Patent Publication (OPI) No. 65695/83; base paper subjected to a corona discharge treatment to acquire an improved coating aptitude, as disclosed in Japanese Patent Publication (OPI) No. 35985/84; and so on can be employed in this invention, and can achieve good results. In addition, any of supports usable in the field of conventional heat sensitive recording materials can be used as the support of this invention.

As examples of polymer films which can be used as support in this invention, mention may be made of polyester films such as polyethylene terephthalate film, polybutylene terephthalate film and the like, films of cellulose derivatives such as cellulose triacetate film, polystyrene films, and polyolefin films such as polyethylene film, polypropylene film, etc. These films may be used individually, or in the form of laminate.

A preferred thickness of the support is from 20 to 200 microns, particularly from 50 to 100 microns.

If all of the recording layers of the present invention are transparent, that is, a haze % thereof are less than 60%, and they are provided on a transparent support, the recording material can be subjected to over head projector (OHP).

Another one or more recording layers may be provided on a back side of the support. In this case it is necessary to make all recording layers transparent except one recording layer which is one of the outer most recording layers of the recording material.

If all recording layers are transparent without exception, the recording material can be used for OHP which can reproduce more than 7 colors. In this case, however, it is also possible to observe reflected image by put the recorded material on a white sheet.

Therefore, it is clear that the reflected image can be observed without above mentioned white sheet if one outermost recording layer, located on the opposite side of the recorded-image observation, is opaque layer. The reflected image can be improved by providing opaque protective layer which contains a lot of white pigment on the opaque recording layer.

Unless both sides of the support are provided with recording layers, a backing layer may be provided on the back side of the support for the purposes of correction of curling, prevention of electrification and improvement of slippability. Ingredients to constitute the backing layer include the same ones as used for the protective layer.

Coating compositions relating to this invention can be coated using well-known coating methods, such as a dip coating method, an air knife coating method, a curtain coating method, a roller coating method, a doctor coating method, a wire bar coating method, a slide coating method, a gravure coating method, an extrusion coating method using a hopper disclosed in U.S. Pat. No. 2,681,294 and so on. Two or more of coating compositions can be coated simultaneously, if desired, using methods as described, e.g., in U.S. Pat. Nos. 2,761,791; 3,508,947; 2,941,898 and 3,526,528, and Yuji Harasaki, Coating Kogaku (which means "Coating Engineering"), p. 253, Asakura Shoten, Tokyo (1973). A proper method can be selected therefrom depending on the desired coverage, the desired coating speed and so on.

It can be safely carried out to admix the coating compositions to be used in this invention with proper amounts of a pigment dispersion, a thickener, a flowability modifier, a defoaming agent, a foam inhibitor, a surface lubricant, a coloring agent, a surfactant and so on, if needed, as far as the characteristics are not impaired thereby.

In embodying this invention, the number of the color-producing layers is not limited to two, but plural color-producing layers can further be provided. In this case, additionally provided layers are generally different from the essential two layers in hue of the color to be produced.

Even when color-producing layers are provided the multilayer form, at least one interlayer disclosed in this invention is provided.

Also, color-producing layers can be provided on both sides of the support.

When a transparent support is used, the above-described embodiment is employed to advantage.

Now, this invention is illustrated in further detail by reference to the following examples. However, the invention should not be construed as being limited to these examples. Additionally, all parts in the following examples are by weight.

EXAMPLE 1

Preparation of Capsule Solution A

| | |
|---|---|
| Diazo compound | 3.4 parts |

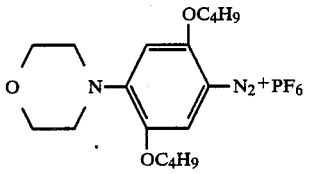

| | |
|---|---|
| Tricresyl Phosphate | 6 parts |
| Methylene chloride | 12 parts |
| Trimethylolpropane Trimethacrylate | 18 parts |
| Takenate D-110N (75 wt % ethyl acetate solution) (trade name of products of Takeda Yakuhin Kogyo K.K.) | 24 parts |

The above-described ingredients were mixed, added to an aqueous mixture of 63 parts of a 8 wt % of water solution of polyvinyl alcohol (PVA-217E; manufactured by Kurare K.K.) and 100 parts of distilled water, and then dispersed thereinto at 20° C. in an emulsified condition. The obtained emulsion had an average droplet size of 3 microns, and the stirring of the emulsion was continued for 3 hours at 40° C.

After the emulsion was cooled to 20° C., and thereto was added 100 ml of Amberlite IR-120B (trade name; products of Rhom & Haas Co.). The resulting mixture was stirred for 1 hour, and then filtered to obtain the intended capsule solution.

Preparation of Coupler/Base Dispersion A

| | |
|---|---|
| 4 wt % Aqueous Solution of Polyvinyl Alcohol (PVA 205; manufactured by Kurare K.K.) | 170 parts |
| Coupler | 14 parts |

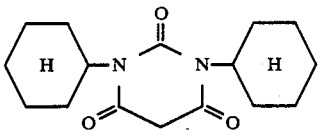

-continued

| | |
|---|---|
| Triphenyl Guanidine (base) | 6 parts |
| Color-production Assistant | 14 parts |

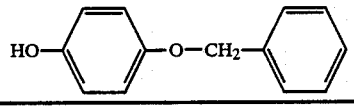

The above-described ingredients were mixed, and dispersed with a Dyno Mill(trade name; produced by Willy A Bachofen A.G.) to obtain a dispersion having an average particle size of 3 microns.

Preparation of Heat Sensitive Dispersion A 20 g of 2-anilino-3-methyl-N-methyl-N-cyclohexylamino-fluoran (color former), 20 g of bisphenol A (color developer) and 20 g of β-naphthylbenzyl ether (sensitizer) were dispersed into separate 100 g portions of a 5% aqueous solution of polyvinyl alcohol (PVA-105; manufactured by Kurare K.K.) using a ball mill over one day and night. All thus obtained dispersions had a volume average particle size of 3 microns or less. In preparing a pigment dispersion, 80 g of calcium carbonate (Unibur 70, trade name; produced by Shiraishi Kogyo K.K.) is used, and it was dispersed into 160 g of a 0.5% sodium hexamethaphosphate with a homogenizer. The thus prepared 2-anilino-3-methyl-N-methyl-N-cyclohexylamino-fluoran dispersion, bisphenol A dispersion, β-naphthylbenzyl ether dispersion and calcium caarbonate dispersion were mixed in amounts of 5 g, 10 g, 10 g and 15 g, respectively, to obtain the intended heat sensitive dispersion A.

Preparation of Protective Layer Composition A

| | |
|---|---|
| 10 wt % Solution of Polyvinyl Alcohol modified with silicon (PVA R2105;manufactured by Kurare K.K.) | 10 parts |
| 30 wt % Solution of Colloidal Silica (Snowtex 30, produced by Nissan Kagaku K.K.) | 5 parts |
| 30 wt % Solution of Zinc Stearate (Hydolin Z-7; produoed by Chukyo Yushi K.K.) | 0.42 part |
| 30 wt % Solution of Paraffin Wax (Hydolin P-7; produced by Chukyo Yushi K.K.) | 0.42 part |

The above-described solutions were mixed to obtain the intended protective layer composition.

Production of Recording Sheet

The heat sensitive dispersion A was coated on wood free paper having a basis weight of 50 g/m$^2$ so as to have a dry coverage of 6 g/m$^2$. Then, an interlayer was formed thereon by coating a 3% aqueous solution of sodium alginate (Snow Algin SH; produced by Fuji Kagaku K.K.) so as to have a dry coverage of 0.5 g/m$^2$.

Subsequently, the mixture of 6 parts of the capsule solution A, 5.5 parts of the coupler/base dispersion A and 0.5 part of the 30% aqueous solution of polyethyleneimine (mean molecular weight: 75) was coated on the interlayer so as to have a dry coverage of 6 g/m$^2$, and further the protective layer composition A was coated at a dry coverage of 2 g/m$^2$ to obtain a recording sheet. All the coating procedures were performed with a wire bar, and the coated layers were dried in a 50° C. oven.

Thermal printing on the thus obtained recording sheet was carried out by application of low energy (thermal head voltage: 15 V, printing time: 0–2.5 msec), then the printed sheet was exposed to light for 10 seconds using a Ricopy Super Dry Type-100 to obtain the color-developed layer of diazo type. Thereafter, thermal printing was performed again by application of energy higher than the foregoing printing energy (thermal head voltage: 15 V, printing time: 2.5–5 msec).

Thus, a clear dichromatic print with red images in the low printing energy-applied part and black images in the high printing energy-applied part was obtained.

This print did not cause any increase in fog and any change in produced color densities even after long-range storage.

COMPARATIVE EXAMPLE 1

A recording sheet was prepared in the same manner as in Example 1, except no interlayer was provided.

The obtained sheet was subjected to the same thermal printing procedues as in Example 1. The thus produced black images had a density somewhat lower than those produced in Example 1.

In addition, yellow to red fog was observed in the printed sheet after long-range storage. When the resulting sheet was subjected to the thermal printing procedures, a remarkable drop in the black color density was caused therein.

EXAMPLE 2

Preparation of Coupler/Base Dispersion B

| | |
|---|---|
| I. 5 wt % Aqueous Solution of Polyvinyl Alcohol(PVA-205; manufactured by Kurare K.K.) | 170 parts |
| II. Coupler | |
| 2-Hydroxy-3-naphthoic Acid Anilide | 12 parts |
| 2,4-Bis(benzoylacetamide)toluene | 2 parts |
| Triphenyl guanidine (base) | 6 parts |
| III. Color-production Assistant | 14 parts |

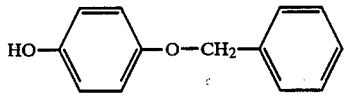

The above-described ingredients were mixed, and dispersed with a Dyno Mill (trade name; produced by Willy A Bachofen A.G) to obtain a dispersion having an average particle size of 3 microns.

Preparation of Capsule Solution B

| | |
|---|---|
| Colorless Electron donating Dye Precursor (CIBA Pargascript Red I-6-B) | 14 parts |

-continued

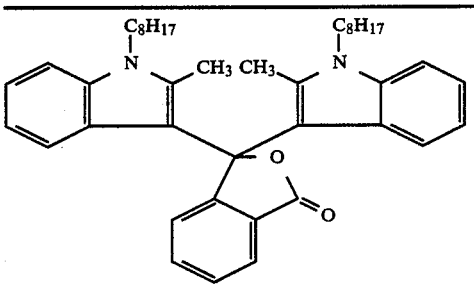

| | |
|---|---|
| 1-Phenyl-1-xylylethane | 55 parts |
| Methylene Chloride | 55 parts |
| Sumisorb 200 (ultraviolet absorbent, produced by Sumitomo Kagaku K.K.) | 2 parts |
| Takenate D-110N (trade name; produced by Takeda Yakuhin Kogyo K.K.) | 60 parts |

The above-described ingredients were mixed, added to a mixture of 100 parts of a 8 wt % aqueous solution of polyvinyl alcohol and 40 parts of distilled water, and dispersed at 20° C. in the emulsified condition to obtain an emulsified dispersion having an average droplet size of 1 micron. The obtained emulsion was further stirred for 3 hours at 40° C. to prepare the intended capsule solution B.

Preparation of Color Developer Dispersion A (Emulsified Dispersion

The color developers (a), (b) and (c) having the following structural formulae were added in amounts of 8 parts, 4 parts and 3 parts, respectively, to a mixture of 8 parts of 1-phenyl-1-xylylethane and 30 parts of ethyl acetate. The obtained solution was mixed with 100 parts of a 8 wt % of aqueous solution of polyvinyl alcohol, 150 parts of water and an aqueous solution containing 0.5 part of sodium dodecylbenzenesulfonate, and dispersed in an emulsified condition to prepare an emulsified dispersion having an average droplet size of 0.5 micron.

Color Developer (a)

Zinc Salt of

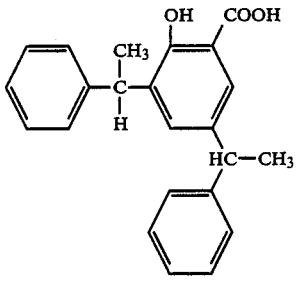

Color Developer (b)

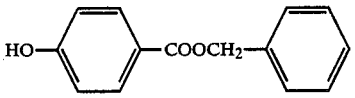

Color Developer (c)

-continued

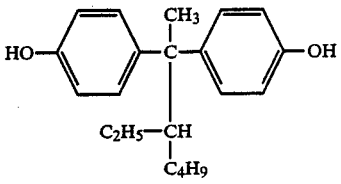

Preparation of Protectove Layer Composition B

| | |
|---|---|
| 10 wt % Aqueous Solution of Polyvinyl Alcohol modified with silicon (PVA R2105; manufactured by Kurare K.K.) | 15 parts |
| 30 wt % Aqueous Solution of Colloidal Silica (Snowtex 30; produced by Nissan Kagaku K.K.) | 8.5 parts |
| 30 wt % Aqueous Solution of Zinc Stearate (Hydolin; produced by Chokyo Yushi K.K.) | 0.42 part |
| 32 wt % Aqueous Solution of Paraffin Wax (Cerozol D-130 produced by Chukyo Yushi K.K.) | 0.54 part |
| 33 wt % Aqueous Silica Dispersion (Mizukasil P-832; produced by Mizusawa Kagaku K.K.) | 1.9 parts |

The above-described solutions were mixed to obtain the intended protective layer composition B.

Production of Recording Sheet

A biaxially stretched polyethylene terephthalate film having a thickness of 75 microns was subjected to a corona discharge treatment, and thereon was coated a mixture of 5.0 parts of the capsule solution B and 10.0 parts of the color developer dispersion A so as to have a dry coverage of 6 g/m$^2$. Then, an interlayer was formed thereon by coating a 3% aqueous solution of sodium alginate (Snow Algin SH; produced by Fuji Kagaku K.K.) so as to have a dry coverage of 0.5 g/m$^2$. Subsequently, a mixture of 6 parts of the capsule solution A, 5.5 parts of the coupler/base dispersion B and 0.5 part of a 10 wt % of aqueous solution of calcium chloride was coated on the interlayer so as to have a dry coverage of 6 g/m$^2$, and further the protective layer composition B was coated at a dry coverage of 2 g/m$^2$ to obtain a recording sheet.

All the coating procedures were performed with a wire bar, and the coated layers wree dried in a 50° C. oven.

Thermal printing on the thus obtained recording sheet was carried out by application of low energy (thermal head voltage: 15 V, printing time: 0–2.5 msec), and then the printed sheet was exposed to light for 10 seconds using a Ricopy Super Dry Type-100 to effect the fixation of the color-developed layer of diazo type. Thereafter, thermal printing was performed again by application of energy higher than the above-described printing energy (thermal head voltage: 15 V, printing time: 2.5–5 msec.).

Thus, a clear dichromatic print with black images in the low printing energy-applied part and magenta images in the high printing energy-applied part was obtained. When the images were observed from the side opposite to the printed parts of the transparent film sheet, they were observed more clearly.

This printed sheet did not cause any increase in fog and an change in produced color densities even after long-range storage.

COMPARATIVE EXAMPLE 2

A recording sheet was prepared in the same manner as in Example 2, except polyvinyl alcohol (PVA-205; produced by Kurare K.K.) was used in the place of sodium alginate for forming the interlayer.

The obtained sheet was subjected to the same thermal printing procedures as in Example 2. The thus produced magenta images had a density somewhat lower than those produced in Example 2.

In addition, yellow to black fog was observed in the printed sheet after long-range storage. When the resulting sheet was subjected to the thermal printing procedures, a remarkable drop in the black color density was caused therein.

EXAMPLE 3

The Coupler/Base Dispersion C was prepared as follows.

Preparation of Coupler/Base Dispersion C

| | |
|---|---|
| I. 4 wt % Aqueous Solution of Polyvinyl Alcohol(PVA-205; manufactured by Kurare K.K.) | 170 parts |
| II. Coupler 2-Hydroxy-3-naphthoic Acid Anilide (Naphthol AS) | 20 parts |
| III. Triphenyl guanidine (base) | 6 parts |
| IV. Color-production Assistant | 14 parts |

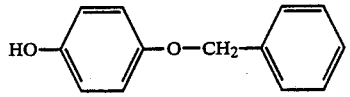

The above-described ingredients were mixed and dispersed with a Dyno Mill (trade name; produced by Willy A Bachofen A.G.) to obtain a dispersion having an average particle size of 3 microns.

Production of Recording Sheet

A mixture of 6 parts of a capsule solution A and 5.5 parts of the coupler/base dispersion C was coated on a wood free paper having a basis weight of 50 g/m$^2$ so as to have a dry coverage of 10.0 g/m$^2$. Then, an interlayer was formed thereon by coating a 3% aqueous solution of sodium alginate (Snow Algin SH; produced by Fuji Kagaku K.K.) so as to have a dry coverage of 0.5 g/m$^2$.

Subsequently, the mixture of 6 parts of the capsule solution A, 5.5 parts of the coupler/base dispersion A and 0.5 part of the 20% aqueous solution of calcium chloride was coated on the interlayer so as to have a dry coverage of 6 g/m$^2$, and further the protective layer composition A was coated at a dry coverage of 2 g/m$^2$ to obtain a recording sheet. All the coating procedures were performed with a wire bar, and the coated layers were dried in a 50° C. oven.

Thermal printing on the thus obtained recording sheet was carried out by application of low energy (thermal head voltage: 15 V, printing time: 0–2.5 msec) and red color image was obtained.

Subsequently, thermal printing was carried out by application of high energy (thermal head voltage: 17 V, printing time: 0–2.5 msec) to obtain black color image.

Then the printed sheet was exposed to light for 10 seconds using a Ricopy Super Dry Type-100. Thereafter, thermal printing was performed again by application of high energy (thermal head voltage: 17 V, printing time: 2.5–5 msec) to obtain blue color image.

This print did not cause any increase in fog and any change in produced color densities even after long-range storage.

COMPARATIVE EXAMPLE 3

A recording sheet was prepared in the same manner as in Example 3, except no interlayer was provided.

The obtained sheet was subjected to the same thermal printing procedures as in Example 3.

In this case, the obtained blue images were muddy and red color was mixed at thermal printing with application of low energy. Moreover, the red images which were obtained after fixation by application of high energy were also muddy and mixed with blue. These color mixing was more remarkable when the recording was performed on a sample after long-range storage.

EXAMPLE 4

Preparation of Heat-sensitive Dispersion B

Heat sensitive dispersion B was obtained in a same manner as in the preparation of heat sensitive dispersion A in Example 1 except the following election donating dye precursor (CIBA Pergascript Blue) was used instead of 2-anilino-3-methyl-N-methyl-N-cyclohexylamino-fluoran.

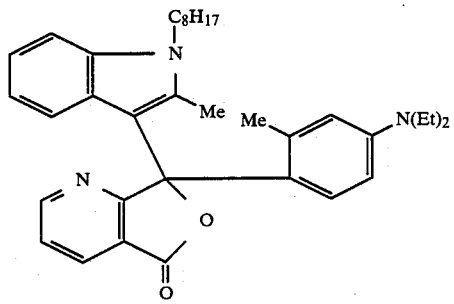

Preparation of Recording Sheet

A heat sensitive dispersion B was coated on wood free paper having a basis weight of 50 g/m$^2$ so as to have a dry coverage of 6 g/m$^2$. Then, an interlayer was formed thereon by coating a 3% aqueous solution of sodium alginate (Snow Algin SH; produced by Fuji Kagaku K.K.) so as to have a dry coverage of 0.5 g/m$^2$.

Subsequently, the mixture of 5.0 parts of the capsule solution B, 10 parts of the color-developer dispersion A and 0.5 part of the 10% aqueous solution of calcium chloride was coated on the interlayer so as to have a dry coverage of 6 g/m$^2$, and further the protective layer composition A was coated at a dry coverage of 2 g/m$^2$ to obtain a recording sheet. All the coating procedures were performed with a wire bar, and the coated layers were dried in a 50° C. oven.

Thermal printing on the thus obtained recording sheet was carried out by application of low energy (thermal head voltage: 15 V, printing time: 0–2.5 msec), thereafter, thermal printing was performed again by application of energy higher than the foregoing printing energy (thermal head voltage: 15 V, printing time: 2.5–5 msec).

Thus, a clear dichroic print with magenta images in the low printing energy-applied part and black images in the high printing energy-applied part was obtained.

This print did not cause any increase in fog and any change in produced color densities even after long-range storage.

COMPARATIVE EXAMPLE 4

A recording sheet was prepared in the same manner as in Example 4, except no interlayer was provided.

The obtained sheet was subjected to the same thermal printing procedures as in Example 4.

In this case, a color mixing was occurred between magenta color in the low printing energy-applied part and cyan color in the lower layer then muddy red color was obtained. Moreover, a black fog was observed after long-range storage.

EXAMPLE 5

Preparation of Coupler/Base Dispersion D

A Coupler/Base Dispersion D was prepared in a same manner as in the Coupler/Base Dispesion A in Example 1 except the following coupler

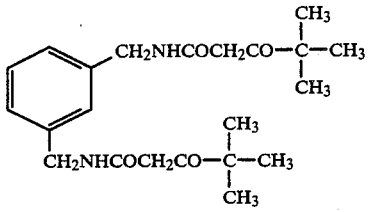

was used instead of

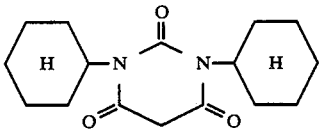

Preparation of Capsule Solution C

A capsule solution C was prepared in a same manner as in the capsule solution B in Example 2 except the CIBA Pergascript Blue

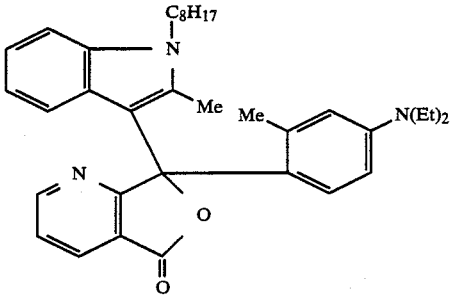

was used instead of CIBA Pergascript Red I-6-B.

Preparation of Protective Layer Composition C

| | |
|---|---|
| 10 wt % Solution of Polyvinyl Alcohol modified with silicon (PVA R2105; manufactured by Kurare K.K.) | 15 parts |
| 30 wt % Solution of Colloidal Silica (Snowtex 30; produced by Nissan Kagaku K.K.) | 8.5 parts |
| 30 wt % Solution of Zinc Stearate (Hydolin Z-7; produced by Chukyo Yushi K.K.) | 0.42 part |
| 30 wt % Solution of Paraffin Wax (Hydolin P-7; produced by Chukyo Yushi K.K.) | 0.54 part |
| 33 wt % Solution of Titanium Oxide (produced by Ishihara Sangyo K.K.) | 1.9 parts |

The above-described solutions were mixed to obtain the intended protective layer composition.

Production of Recording Sheet

A biaxially stretched polyethylene terephthalate film having a thickness of 75 microns was subjected to a corona discharge treatment, and thereon was coated a mixture of 5.0 parts of the capsule solution C and 10.0 parts of the color developer dispersion A so as to have a dry coverage of 6 g/m$^2$. Then, an interlayer was formed thereon by coating a 1% aqueous solution of sodium alginate (Snow Algin SH; produced by Fuji Kagaku K.K.) so as to have a dry coverage of 1 g/m$^2$.

Subsequently, a mixture of 6 parts of the capsule solution A, 5.5 parts of the coupler/base dispersion D and 0.1 part of a aqueous solution of calcium chloride was coated on the interlayer so as to have a dry coverage of 6 g/m$^2$, and further the protective layer composition C was coated at a dry coverage of 2 g/m$^2$.

On an another side of aforementioned polyethylene terephthalate film a mixture of 5.0 parts of the capsule solution B and 10.0 parts of the color developer dispersion A was coated so as to have a dry coverage of 6 g/m$^2$, and further the protective layer composition A was coated at a dry coverage of 2 g/m$^2$ to obtain a recording sheet.

All the coating procedures were performed with a wire bar, and the coated layers were dried in a 50° C. oven.

Thermal printing on the thus obtained recording sheet was carried out from the first side, the protective layer of this side has the protective layer composition of C, by application of low energy (thermal head voltage: 13 V, printing time: 0–2.5 msec), and then the printed sheet was exposed to light for 10 seconds using a Ricopy Super Dry Type-100 to effect the fixation of the color-developed layer of diazo type. Thereafter, thermal printing was performed again by application of energy higher than the above-described printing energy (thermal head voltage: 18 V, printing time: 2.5–5 msec.).

Thus, a clear dichromatic print with yellow images in the low printing energy-applied part and cyan images in the high printing energy-applied part was obtained.

Then, the another side which was coated the coating solution A was thermally printed by high thermal energy (thermal head energy: 15 V, printing time: 0–5 msec) and magenta images were obtained.

A full color image was obtained by observing the images from the side on which the protective layer composition A (that is, for transparent protective layer) had been coated.

This printed sheet did not cause any increase in fog and any change in produced color densities even after long-range storage.

What is claimed is:

1. A multicolor recording material which comprises a support having on one side thereof at least two color-producing recording layers capable of producing colors different from each other in hue through corresponding color-producing reactions, every adjacent two of said color-producing recording layers having therebetween an interlayer comprising of a water-soluble polyanionic polymer having gelled through the interaction with polycation.

2. A multicolor recording material as claimed in claim 1, at least one layer out of said color-producing recording layers contains both of a diazo compound and a coupler as color-producing ingredients.

3. A multicolor recording material as claimed in claim 2, wherein said diazo compound is contained in microcapsule.

4. A multicolor recording material as claimed in claim 1, at least one layer out of said color-producing recording layers contains both of an electron donating dye precursor and a developer as color-producing ingredients.

5. A multicolor recording material as claimed in claim 4, wherein said electron donating dye precursor is contained in microcapsule.

6. A multicolor recording material as claimed in claim 1, wherein said support is transparent.

7. A multicolor recording material as claimed in claim 6, wherein at least one color-produced recording layer capable of producing color different from any other layer in hue is further provided on another side of said transparent support.

8. A multicolor recording material as claimed in claim 7, wherein Haze % of all color-producing recording layers except one of outer most color-producing recording layer are less than 60%.

9. A multicolor recording material as claimed in claim 8, wheein a transparent protective layer is provided on the outer most color-producing recording layer having Haze % of less than 60% and an opaque protective layer is provided on the outer most color-producing recording layer having Haze % of more than 60%.

10. A multicolor recording material as claimed in claim 7, wherein Haze % of all color-producing recording layers are less than 60%.

11. A multicolor recording material as claimed in claim 10, wherein a transparent protective layer is provided on one outer most color-producing recording layer and an opaque protective layer is provided on another outer most color-producing recording layer.

12. A multicolor recording material as claimed in claim 10, wherein transparent protective layers are provided on both outer most color-producing recording layers.

13. A multicolor recording material as claimed in claim 1, wherein said interlayer contains an ion complex of a water-soluble polyanionic polymer and a water-soluble polycationic polymer.

* * * * *